US006851269B2

(12) United States Patent
Nomura et al.

(10) Patent No.: US 6,851,269 B2
(45) Date of Patent: Feb. 8, 2005

(54) APPARATUS AND METHOD FOR CALCULATING REFILL AMOUNT OF REFRIGERANT

(75) Inventors: Toshiyuki Nomura, Kyoto (JP); Hiroji Kohsaka, Kyoto (JP); Yasuyuki Nakanishi, Kyoto (JP); Kennosuke Kojima, Kyoto (JP)

(73) Assignee: Horiba, Ltd., Kyoto (JP)

( * ) Notice: Subject to any disclaimer, the term of this patent is extended or adjusted under 35 U.S.C. 154(b) by 0 days.

(21) Appl. No.: 10/665,434

(22) Filed: Sep. 22, 2003

(65) Prior Publication Data

US 2004/0055317 A1 Mar. 25, 2004

(30) Foreign Application Priority Data

Sep. 25, 2002 (JP) ..... P. 2002-279929

(51) Int. Cl.[7] ..... F25B 45/00
(52) U.S. Cl. ..... 62/149; 62/77
(58) Field of Search ..... 62/77, 149, 292

(56) References Cited

U.S. PATENT DOCUMENTS 5,024,061 A * 6/1991 Pfeil, Jr. et al. ..... 62/77
5,711,158 A 1/1998 Yoshida et al.
5,802,859 A * 9/1998 Zugibe ..... 62/125
6,000,230 A 12/1999 Kanno et al.
6,035,648 A 3/2000 Hickman et al.
6,141,977 A 11/2000 Zugibe
2003/0034454 A1 2/2003 Nomura et al.

FOREIGN PATENT DOCUMENTS

JP 8-136091 A 5/1996

OTHER PUBLICATIONS

Patent Abstracts of Japan, abstracting JP 11–63745, published Mar. 5, 1999, vol. 1999, No. 08.

* cited by examiner

*Primary Examiner*—Melvin Jones
(74) *Attorney, Agent, or Firm*—Sughrue Mion, PLLC

(57) ABSTRACT

A refrigerant refill amount calculating apparatus is provided with concentration measuring units for measuring component ratios $X_1:Y_1:Z_1$ of fluorocarbon S contained in a refrigerating machine, and a calculation processing unit. The calculating unit calculates additional filling amounts of respective refrigerant components which are required to fill fluorocarbon having a defined amount "A" in accordance with defined component ratios X:Y:Z within the refrigerating machine 2 based upon an additional filling amount Xa of a refrigerant component which has been additionally filled into the refrigerating machine, and a change amount of component ratios $X_1:Y_1:Z_1$, $X_2:Y_2:Z_2$ which have been measured before and after the refrigerant component was filled. Refill amounts of refrigerant components can be easily calculated in a correct manner.

5 Claims, 5 Drawing Sheets

APPARATUS AND METHOD FOR CALCULATING REFILL AMOUNT OF REFRIGERANT

BACKGROUND OF THE INVENTION

The present invention is related to an apparatus and a method for calculating refill amount of refrigerant.

Generally speaking, so-called "fluorocarbon" is conventionally used as refrigerants which are employed in refrigerating apparatus (cooling machines) such as, more specifically, refrigerators and air conditioners. As to fluorocarbon, there is an HFC series of new refrigerants in addition to a CFC series and an HCFC series of old refrigerants. These series of fluorocarbon own various problems as to destruction of the ozone layer, and warming trends in earth temperatures, so that there are duties to collect and recycling-use the above-described fluorocarbon. Also, such fluorocarbon which cannot be recycling-used must be firmly destructed.

On the other hand, the fluorocarbon of R410A, R407C, R404A, R507A, which is typically known as the new refrigerants, corresponds to such mixed refrigerants which are formed by mixing several sorts of single component fluorocarbon (R32, R125, R134*a*, R143*a* etc.) with each other in predetermined ratios. In addition, there is fluorocarbon R502 of the old refrigerant as the mixed refrigerant.

On the other hand, in the case that refrigerating apparatus using the above-explained refrigerants are utilized for a long time period, the refrigerants are leaked from joints of pipes, so that heat exchanging performance of the refrigerating apparatus will be lowered. Therefore, in such a case, after the refrigerating apparatus have been repaired, the leaked refrigerant components must be refilled into these refrigerating apparatus. In the case of such a refrigerating machine using a mixed refrigerant, amounts of additionally filled refrigerant components must be changed in accordance with such a condition that what sort and how degree of the mixed refrigerant components have been leaked.

Accordingly, JP-A-8-136091 proposes the mixed-refrigerant filling method capable of additionally filling the mixed refrigerant, by which while the measurement is made of such a relationship among the temperatures of the refrigerants, the sound velocities thereof, the pressure thereof, which have been filled into the refrigerating machine used as a refrigerator and an air conditioner, the necessary refrigerant components are automatically filled in such a manner that the concentration ratios of the respective refrigerant components calculated by employing these measured values are entered in a predetermined range.

There is such an important aspect that when a mixed refrigerant is filled into a refrigerating machine, concentration ratios of the respective refrigerant components of this mixed refrigerant must be entered into a predetermined range. However, there is another important aspect that since such a mixed refrigerant having a defined amount fitted to a capacity of this refrigerating machine is required with respect to this refrigerating machine, filling amounts of the respective mixed refrigerant components which have been reduced due to leakage of the refrigerants must be managed. However, the above-explained patent publication also does not clearly describe the controlling operation as to the filling amounts of the mixed refrigerant components. There is no way to grasp amounts of refrigerant components which are left in the refrigerating machine by merely measuring concentration ratios of mixed refrigerant components. As a result, for example, in such a case that the respective refrigerant components of a mixed refrigerant are equally reduced, leaked amounts of the mixed refrigerant components cannot be judged.

In other words, since there is no such a means for precisely judging a defined amount with a refrigerating machine, filling amounts must be judged based upon experiences of an operator by considering output data of a pressure meter and the like. Also, the following technical idea may be conceived. That is, in order to grasp a total amount of mixed refrigerant components which have already been filled into this refrigerating machine, all of these mixed refrigerant components are once extracted from the refrigerating machine so as to be measured. However, this technical idea may cause such a problem that a large-scaled apparatus is necessarily required and a plenty of working time is necessarily consumed.

In addition, as explained in the above-explained patent publication, three sets of measuring devices must be provided in order to individually measure temperatures of refrigerants, sound velocities thereof, and pressure thereof. Such an arrangement may require a large-scaled mixed-refrigerant filling apparatus. Moreover, a controller for automatically controlling additionally filling amounts of refrigerants, electromagnetic valves, and pipes must be made more complex, and must be made bulky.

Also, in order to measure the respective refrigerant component ratios from the relationship among the temperatures of the refrigerants, the sound velocities thereof, and the pressure thereof, a large number of analytical curves are required which have been measured by intentionally changing the three dimensions, so that there is another problem that the concentration calculating operations must be carried out in a complex manner. Then, in such a case that the respective component concentration of such a mixed refrigerant made by mixing three, or more refrigerant components with each other is measured, analytical curves having further cumbersome three-dimensional broad slopes are required, so that the measuring sequential operations become difficult. Moreover, even when such a mixed refrigerant made by mixing these refrigerant components in a new mixing ratio will be employed in a future, the conventional mixed refrigerant filling method cannot immediately accept such a mixed refrigerant whose analytical curve has not yet been prepared. Also, since the mixed refrigerants under the completely same conditions can be hardly measured by the three measuring devices, there is a certain limitation in measuring precision.

As a consequence, generally speaking, each of the respective operators has once extracted all of refrigerants filled in a refrigerating machine and then newly fills necessary amounts of mixed refrigerants instead of such an operation that these operators inject the refrigerant components into the refrigerating machine by using a large-scaled apparatus. This may cause cost for disposing/filling fluorocarbon to be increased.

SUMMARY OF THE INVENTION

The present invention has been made to solve the above-described problems, and therefore, has an object to provide an apparatus and a method for calculating refill amount of refrigerant, having a compact structure, in a correct manner and an easy manner.

To achieve the above-described object, an apparatus for calculating refill amount of refrigerant comprises: a concentration measuring unit which measures component ratios of a mixed refrigerant contained in a refrigerating machine; and a calculation processing unit which calculates refill amounts of refrigerant components which are required to fill a mixed refrigerant having a defined amount in defined component ratios into the refrigerating machine based upon an amount of a refrigerant component which has been additionally filled into the refrigerating machine, and also, a change amount of component ratios which have been measured before and after the refrigerant component was filled.

As a consequence, since the refill amount calculating apparatus of the present invention is employed, a small amount of a sample is acquired from the mixed refrigerant contained in the refrigerating machine, and the acquired sample is measured by the concentration measuring unit so as to measure refrigerant component ratios of this sample, so that refill amounts of refrigerant components which should be required to be filled into the refrigerating machine can be calculated based upon an amount of a refrigerant component which has been additionally filled at the first time, and also, a change amount of component ratios which have been measured before and after the refrigerant component was filled. While an operator merely fills the respective refrigerant components in accordance with the instruction instructed by the output unit, the mixed refrigerant can be defined every refrigerating machine, and further, such refrigerant component ratios of the respective refrigerant components can be obtained by which the maximum performance of the refrigerating machine can be realized. Also, a total amount of these refrigerant components can be firmly fitted into the defined range.

Also, all of the refrigerants which have already been filled in the refrigerating machine need not be extracted therefrom, but also, the short refrigerant components may be merely filled into the refrigerating machine by a short amount thereof. As a result, the extracted refrigerant components need not be disposed, but also, such a cost required for refilling the mixed refrigerant can be considerably reduced, although these extracted refrigerant components should be disposed in the prior art. Furthermore, according to the refill amount calculating apparatus, in view of the preservation of the earth environment, the energy consumption required to dispose the fluorocarbon can be reduced, the manufacturing cost of newly manufacturing fluorocarbon can be lowered, and the physical distribution cost required to transport the fluorocarbon can be decreased, so that productions of $CO_2$ gas may be reduced in a broad sense.

In the case that the refill amount calculating apparatus is provided with an output unit for instructing the refill amounts of the refrigerant components calculated in the calculation processing unit, the operator can confirm the output content, and thus, can readily fill a proper amount of refrigerant components. Also, in such a case that the concentration measuring unit includes a measuring cell for conducting the mixed refrigerant, an infrared light source for irradiating infrared rays to the measuring cell, and a detecting unit for detecting light which has passed through the measuring cell, the arrangement of the concentration measuring unit for measuring the component ratios of the mixed refrigerant can be made compact.

On the other hand, U.S. Publication 2003-0034454A has proposed a method for simply measuring refrigerant component ratios of fluorocarbon. That is, assuming now that a total number of refrigerant components which should be measured is selected to be "n", these refrigerant component ratios of this fluorocarbon are measured by employing such a non-dispersion type infrared gas analyzing method having a detection unit which contains "n" pieces of optical filters capable of penetrating therethrough infrared rays having a specific wavelength range fitted to an infrared absorption spectrum of each of these refrigerant components, and also contains "n" sets of solid-state detectors corresponding to "n" pieces of these optical filters. Then, while absorbance is calculated based upon a measurement value of each of these solid-state detectors, the calculated absorbance is analyzed so as to obtain concentration of the respective refrigerant components (component ratios).

Furthermore, the above-explained concentration measuring unit capable of measuring the component ratios by employing the infrared absorption spectra can be arranged in a compact structure. Also, the measurement precision can be made high by calculating the concentration of the respective refrigerant components with employment of the infrared rays in the specific wavelength range. As a result, the filling amounts of the respective refrigerant components can be calculated in high precision by employing the component ratios measured in this higher measuring precision. In addition, in such a case that the component ratios are measured by employing the infrared absorption spectra, the concentration of the respective refrigerant components can be directly calculated irrespective of combinations of these refrigerant components. As a consequence, even when a new mixed refrigerant will be employed in a future, the refrigerant refill amount calculating apparatus may properly accept this new mixed refrigerant.

It should be understood that the above-described concentration measuring unit is not limited only to the non-dispersion type infrared gas analyzing meter with employment of the solid-state detectors, but may be realized by employing such a gas analyzing meter using another optical method. Moreover, the above-described concentration measuring unit may be realized by employing a mass spectrometer. In this alternative case, measuring precision may be furthermore improved, and also, an amount of a mixed refrigerant which is acquired from the refrigerating machine so as to measure component ratios may be selected to be very small amount.

A method for calculating refill amount of refrigerant, according to the present invention, is featured by that after refrigerant component ratios of a mixed refrigerant filled into a refrigerating machine have been measured, a small amount of refrigerant components is additionally filled; and refrigerant component ratios of a mixed refrigerant are again measured, so that additionally filling amounts of respective refrigerant components are calculated in order to fill a mixed refrigerant having a defined amount in defined refrigerant component ratios into the refrigerating machine.

Alternatively, in this refill amount calculating method, infrared rays may be caused to pass through the mixed refrigerant, and then, penetrated infrared rays maybe detected so as to obtain the refrigerant component ratios of the mixed refrigerant.

DETAILED DESCRIPTION OF THE PREFERRED EMBODIMENTS

Figure 1:
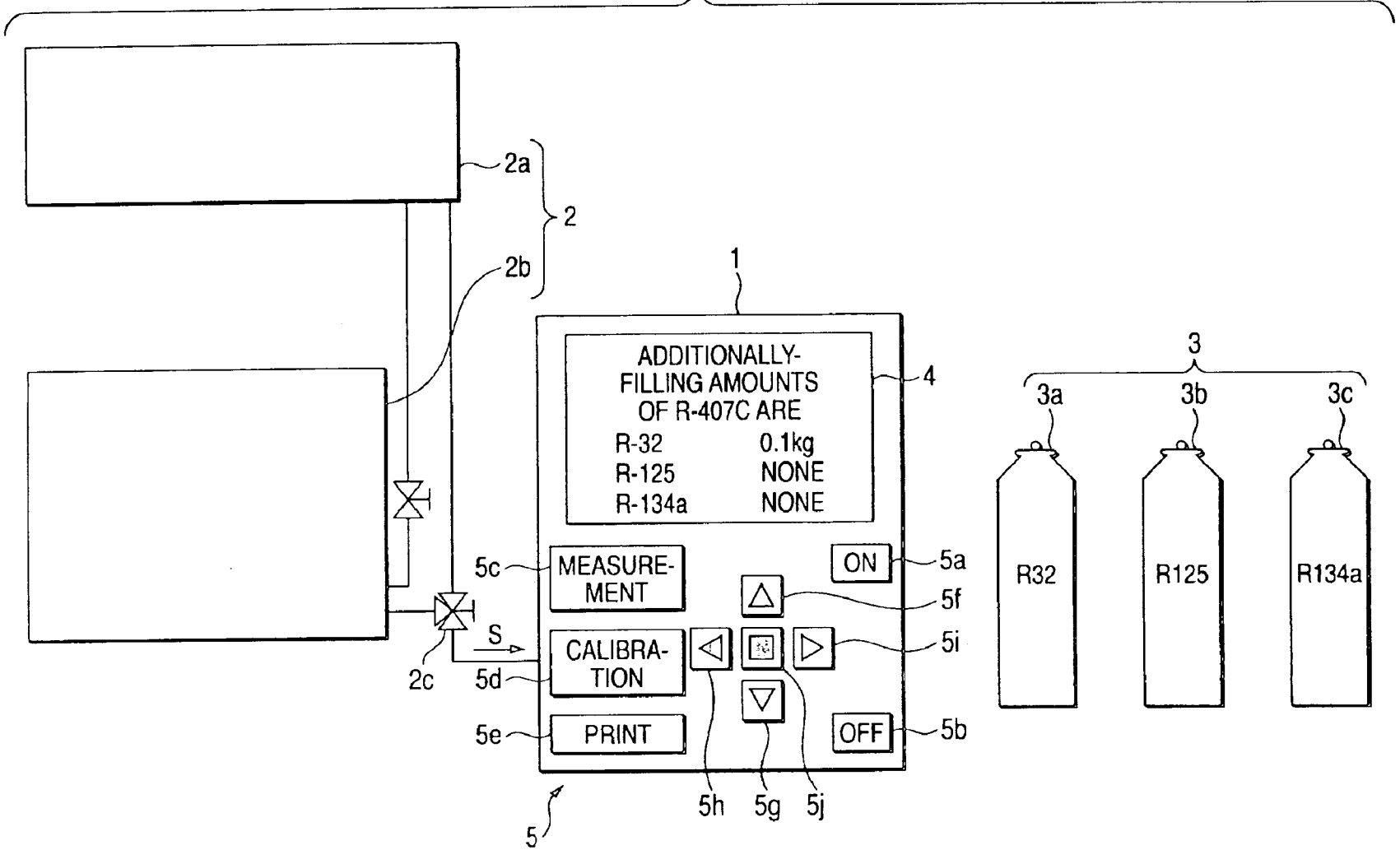
FIG. 1 is a diagram for showing a refrigerant filling example with employment of a refill amount calculating apparatus according to the present invention.

FIG. 1 is a diagram for illustratively showing a filling method of mixed refrigerants of a refrigerating machine 2 using a refrigerant refilling amount calculating apparatus 1 according to the present invention. In FIG. 1, reference numeral 2*a* shows an indoor machine of the refrigerating machine 2, reference numeral 2*b* indicates an outdoor machine of the refrigerating machine 2, reference 2*c* shows a service valve provided in a flow path of a refrigerant (fluorocarbon gas), and reference numeral 3 represents a storage device of the respective refrigerant components which are filled into the refrigerating machine 2. In this embodiment mode, this storage device 3 corresponds to gas Bombe 3*a* to 3*c* which have stored thereinto fluorocarbon R32, fluorocarbon R125, and fluorocarbon R134*a*, respectively.

Reference numeral 4 shows a display unit corresponding to an example of an output unit of the refrigerant refill amount calculating apparatus 1, and reference numeral 5 indicates a keyboard corresponding to an example of an input unit of the refrigerant refilling amount calculating apparatus 1. Also, in order that this refrigerant refill amount calculating apparatus 1 of this embodiment mode may be constructed as a compact apparatus which may be easily handled by operators, the keyboard 5 may be made simpler and may be arranged by power supply buttons 5*a*/5*b*, a measuring button 5*c*, a calibration button 5*d*, a print button 5*e*, cursor buttons 5*f* to 5*i*, and an enter button 5*j*.

Also, since the refrigerant refill amount calculating apparatus 1 of the present invention is communicated and coupled to, for example, the service valve 2*c*, fluorocarbon "S" of several grams may be extracted as a sample from a liquid phase of fluorocarbon which has been filled into the refrigerating machine 2, and then, component ratios of refrigerant components of this fluorocarbon sample may be measured.

Figure 2:
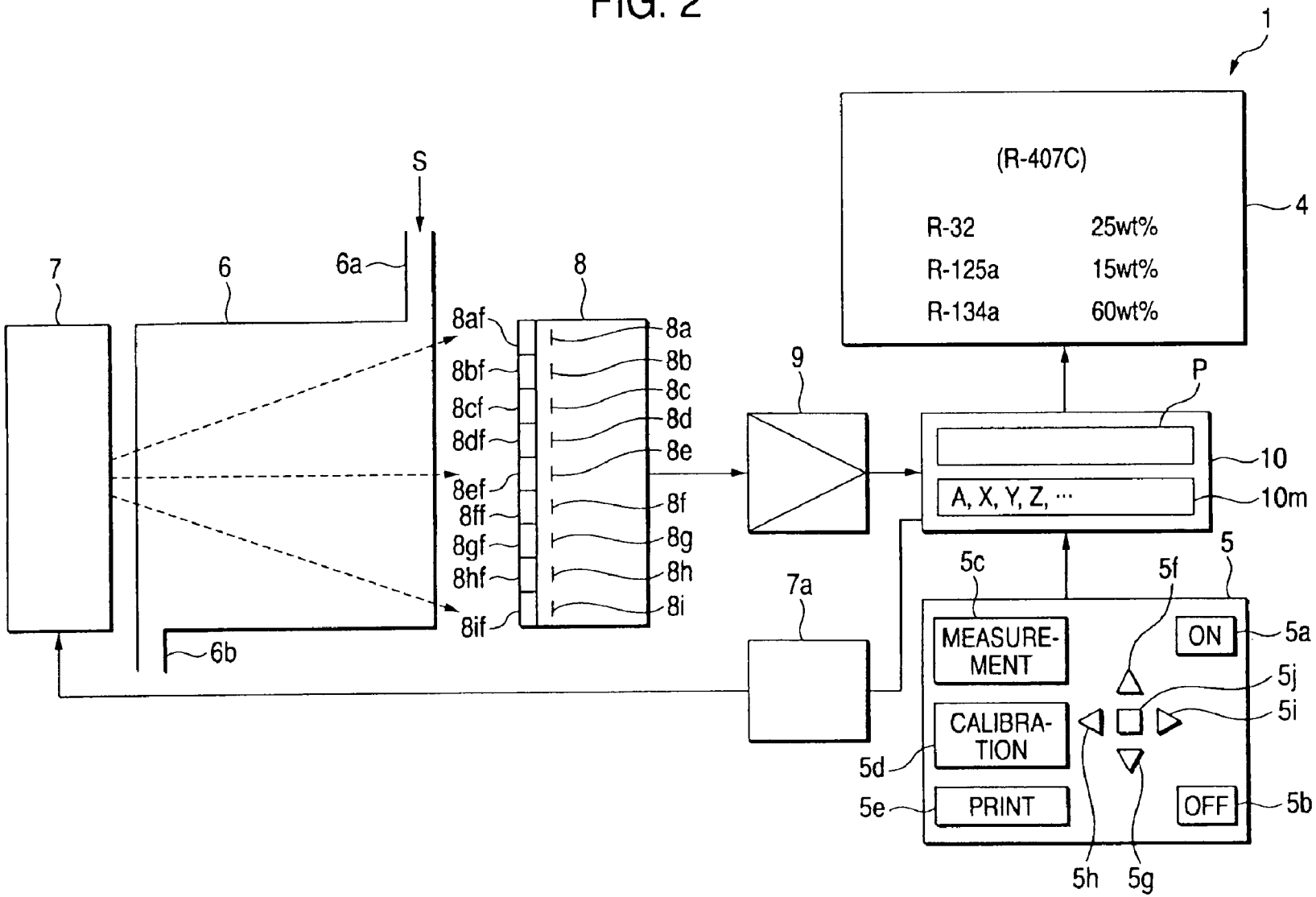
FIG. 2 is a diagram for indicating an entire arrangement of the refill amount calculating apparatus.

FIG. 2 is a diagram for schematically indicates an arrangement of the above-explained refrigerant refill amount measuring apparatus 1. In FIG. 2, reference numeral 6 indicates a measuring cell used to conduct the fluorocarbon "S" which has been collected as one example of a measuring subject sample, and reference numeral 7 indicates an infrared light source for irradiating infrared rays to the measuring cell 6. Also, reference numeral 8 indicates a detecting unit functioning as a concentration measuring unit for the respective refrigerant components by detecting transmission light of the infrared rays, which has passed the measuring cell 6. Reference numeral 9 shows an amplifier for amplifying a detection output from the detecting unit 8. Reference numeral 10 represents a calculation processing unit which executes a calculation process program "P" so as to perform an analyzing operation. In accordance with this calculation process program P, intensity of transmission light amplified by the amplifier 9 is calculated/processed so as to acquire concentration (for example, weight %) indicative of component ratios of the respective refrigerant components.

The measuring cell 6 of this embodiment mode owns a conducting portion 6*a* and an extracting portion 6*b*, while this conducting portion 6*a* is communicated to, for example, the above-explained service valve 2*c* so as to conduct the fluorocarbon S into the measuring cell 6. Then, in this refrigerant refill amount calculating apparatus 1, the fluorocarbon S which has been collected into Bombe (not shown in this drawing) is acquired and conducted from the conducting port 6*a* into the measuring cell 6. Under such a condition that the fluorocarbon S is filled into the measuring cell 3, concentration of this filled fluorocarbon S is measured.

The above-described infrared light source 7 is, for example, a thin-film light source, and reference numeral 7*a* corresponds to a light source control unit of this thin-film light source 7. Then, while the light source control unit 7*a* supplies electric power to the thin-film light source 7 in an intermittent manner, the thin-film light source 7 irradiates infrared rays in the intermittent manner in connection with the supply of electric power from the light source control unit 7*a*, so that such a detecting unit 8 as a pyroelectric type detector may be employed. This pyroelectric type detector produces a signal which is directly proportional to a change of incident infrared rays. Also, the thin-film light source 7 can be made not only compact as well as can be operated in small power consumption, as compared with a general-purpose infrared light source, but also can emit the infrared rays in the interrupted manner in combination with the above-described light source control unit 7*a*. As a result, a chopper having a mechanical drive unit is no longer provided.

In other words, in the non-dispersion type infrared gas analyzing apparatus, since the above-described arrangement is employed, the infrared gas analyzing apparatus can be made compact, and the manufacturing cost thereof can be reduced. Further, warming-up operation of this infrared gas analyzing apparatus can be eliminated, so that easy operations thereof can be achieved. In addition, since the mechanically operating member is omitted, the operation of this infrared gas analyzing apparatus can be carried out under stable condition, and also, occurrences of malfunction thereof can be suppressed.

The detecting unit 8 contains 9 sorts of optical filters "8*af*" to "8*if*", and pyroelectric type detectors "8*a*" to "8*i*" which are employed in correspondence with the respective optical filters 8*af* to 8*if*. Since the pyroelectric type detectors 8*a* to 8*i* are employed as the detector in this embodiment mode, each of light receiving areas of these detectors can be made very small, for example, on the order of 0.1 to 1 $mm^2$, and a large number of these pyroelectric type detectors 8*a* to 8*i* and also a large number of these optical filters 8*af* to 8*if* can be provided in the array form. Seven sorts of optical filters 8*af* to 8*gf* among the 9 sorts of optical filters 8*af* to 8*if* may limit wavelengths of infrared rays which may pass through these seven optical filters to a predetermined range in order to be fitted to infrared absorption spectra of 7 sorts of refrigerant components contained in the fluorocarbon S.

As apparent from the foregoing description, this does not imply that the respective refrigerant components contained in the collected fluorocarbon S are limited only to 7 sorts of refrigerant components in the refrigerant refill amount calculating apparatus 1 of the present invention. Even when how many refrigerant components of fluorocarbon are contained in the fluorocarbon S, a total number of optical filters 8*af* to 8*if* and also a total number of pyroelectric type detectors 8*a* to 8*i* may be set in accordance with a refrigerant component number of fluorocarbon S to be handled. The total number of these optical filters and pyroelectric type detectors are equal to at least a total number of refrigerant components contained in fluorocarbon S to be handled.

In this example, since the optical filters and the pyroelectric type detectors are employed as a reference purpose in order to correct light amount variations of the light source by employing such a wavelength range where infrared absorptions of the respective refrigerant components do not occur, and also are employed so as to measure concentration of lubricating oil mixed into refrigerants and also to perform the HC measurement, the total number of these optical filters and of pyroelectric type detectors are selected to be larger than the total number of fluorocarbon components by 2.

In other words, the refrigerant refill amount calculating apparatus 1 of this embodiment mode employs as the detecting unit 8, plural sets of optical filters and pyroelectric type detectors, the total numbers of which are larger than, or equal to at least a total number of measuring gas sorts and of realizing reference purpose.

Then, the calculation processing unit 10 employs a storage unit 10*m*. This storage unit 10*m* stores as analytical curves (calibration curves), characteristics of the respective detectors 8*a* to 8*i*, characteristics of the optical filters 8*af* to 8*if*, and furthermore, light absorbing characteristics of infrared rays by the respective refrigerant components, as well as magnitudes of mutual interference. Also, since the calculation processing unit 10 executes the calculation process program P, this calculation processing unit 10 executes the calculation processing operation by employing measurement values entered from the respective detectors 8*a* to 8*i* and the analytical curves stored in the storage unit 10*m* so as to calculate component ratios (weight %) as to the respective refrigerant components of the fluorocarbon S.

Figure 3:
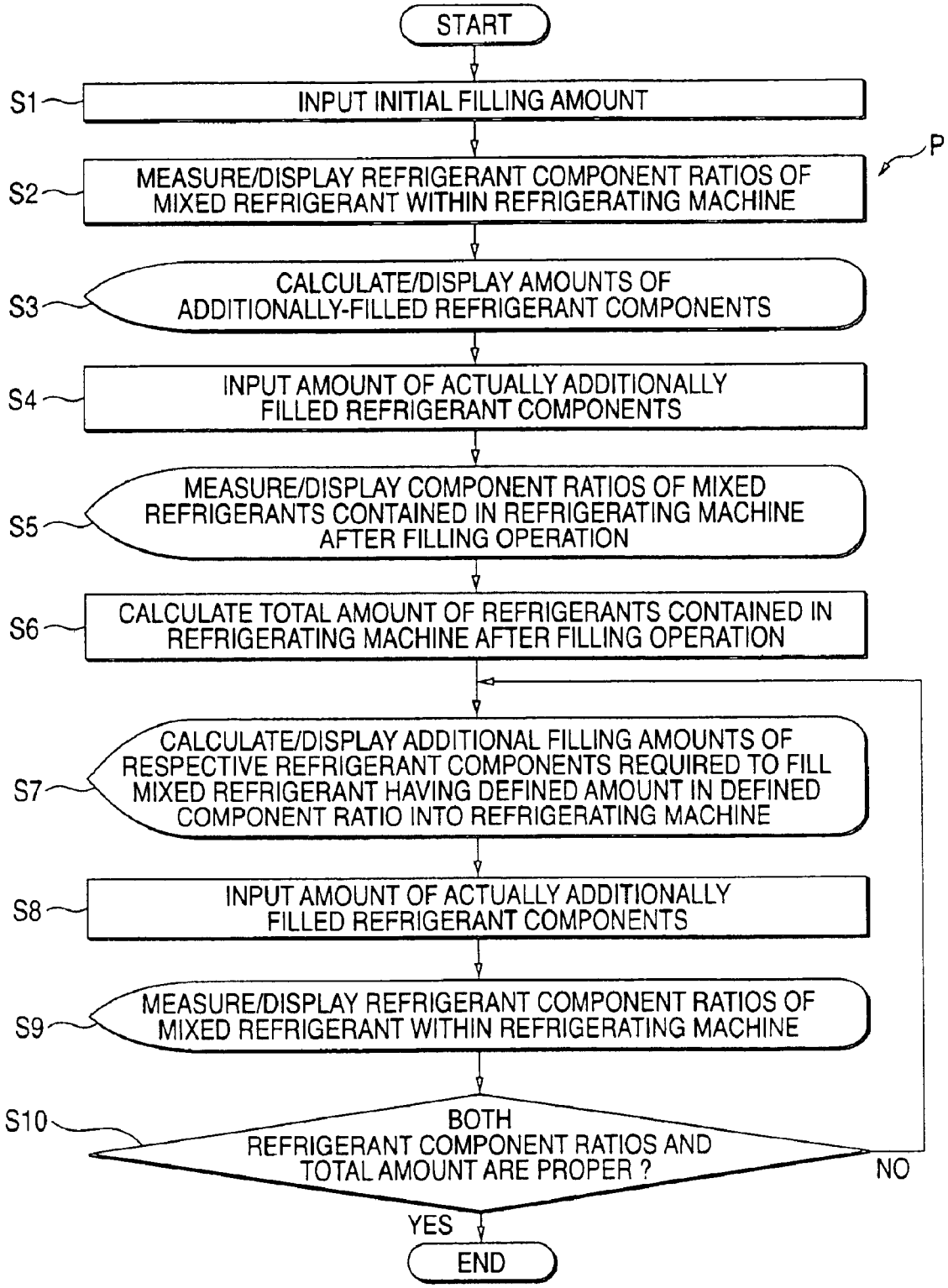
FIG. 3 is an explanatory diagram for explaining a refill amount calculating method according to the present invention.

FIG. 3 is a flow chart for indicating a sequential operation of the refrigerant refill amount calculating method executed by the above-described program P. FIG. 4 to FIG. 10 are diagrams for illustratively showing one example of display contents displayed in the display unit 4 in the below-mentioned respective steps.

Figure 4:
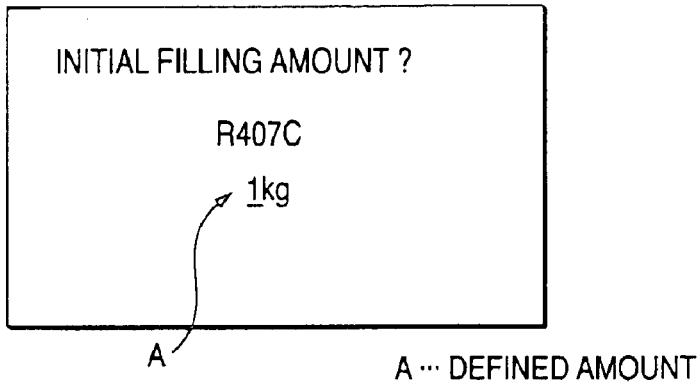
FIG. 4 is a diagram for indicating a display example of a display screen made by the refill amount calculating method while the refrigerants are filled.

In FIG. 3, a step S1 is an input step of an initial filling amount. FIG. 4 represents a display content when the initial filling amount is entered. When an operator initiates the refrigerant refill amount calculating apparatus 1, the operator confirms sorts of refrigerant components and total amounts of these refrigerant components required for the refrigerating machine 2 by checking a manual of this refrigerating machine 2 used to additionally fill cooling components, and then, enters the confirmed sorts and total amounts of these refrigerant components by using the cursor keys 5*f* to 5*i* and the enter key 5*j* etc.

It is so assumed that the sort of the refrigerant entered at this time is a mixed refrigerant R407C, and the initial filling amount of this mixed refrigerant R407C is "A" kg (FIG. 4 indicates a display example when initial filling amount is 1 kg). In such a case that the keyboard 5 owns a ten-numeral entry key, the sort of this mixed refrigerant and the initial filling amount thereof may be entered as numeral values by operating this ten-numeral entry key. However, in this example, such an example is represented in which the numeral values are increased/decreased by employing the cursor keys 5*f* to 5*i*.

Also, since component ratios of the respective refrigerant components contained in general-purpose fluorocarbon have been previously stored in the calculation processing unit 10, although component ratios of respective refrigerant components need not be successively inputted, these component ratios may be arbitrarily entered so as to be set. Alternatively, a component ratio of a new refrigerant component may be registered to be stored in the storage unit 10*m*. Since this new refrigerant component may be stored, even when a new mixed refrigerant is employed in a future, this refrigerant refill amount calculating apparatus 1 may readily accept to process this new mixed refrigerant.

A step S2 corresponds to a step for measuring component ratios of a mixed refrigerant contained in the refrigerating machine 2. In other words, the refrigerant refill amount calculating apparatus 1 acquires the fluorocarbon S of several grams as a sample from the refrigerating machine 2, irradiates infrared rays to this acquired sample fluorocarbon S, and analyzes infrared absorption spectra of transmission light which has been measured by employing the detecting unit 8, and then, calculates component ratios of the fluorocarbon S based upon the infrared light absorption characteristic.

A step S3 corresponds to such a step for calculating amounts of refrigerant components which are additionally filled. In this case, component ratios of the respective refrigerant components R32, R125, and R134*a* of the filled component (namely, R407C in this case) are X:Y:Z which have been previously stored in the storage unit 10*m*. Then, it is so assumed that the component ratios which have been obtained by measuring the fluorocarbon S newly acquired from the refrigerating machine 2 at this time are $X_1$:$Y_1$:$Z_1$. Based upon the above-described information, the calculation processing unit 10 predicts and calculates sorts of insufficient refrigerants and filling amounts thereof and displays the predicted sorts and the calculated filling amounts of the insufficient refrigerants.

Figure 5:
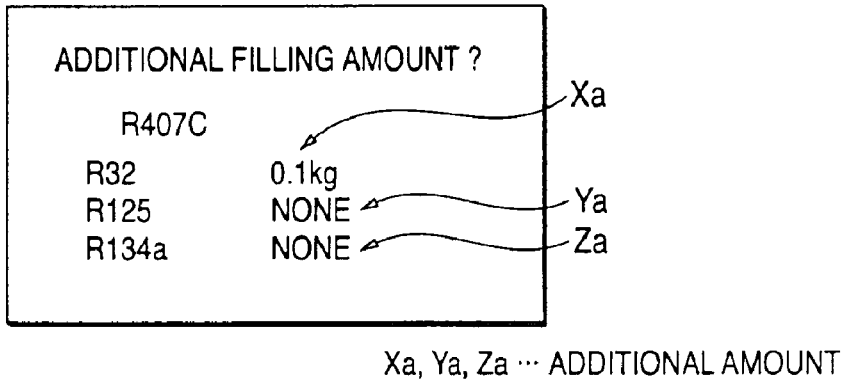
FIG. 5 is a diagram for representing another display example of the display screen made by the refill amount calculating method while the refrigerants are filled.

In other words, it is so assumed that since the above-explained measurement results are employed, such a refrigerant component that the component ratio $X_1$:$Y_1$:$Z_1$ becomes minimum with respect to the initial component ratio X:Y:Z has been leaked. Assuming now that the component ratio "$X_1$" of the refrigerant component R32 has been reduced in maximum based upon the respective relationships between $X_1$ and X, $Y_1$ and Y, $Z_1$ and Z, the following assumption can be made. That is, this refrigerant component R32 has been leaked due to some reasons in the refrigerating machine 2, and thus, this refrigerant component R32 has been short. As a consequence, the calculation processing unit 10 executes such a calculation as shown in the below-mentioned formula (1) and can calculate an amount "Xa" of a refrigerant component which is firstly and additionally filled. FIG. 5 shows a display content of the display unit 4 at this stage.

$$Xa=A*(X-X_1) \qquad \text{formula (1)}$$

Assuming now that the above-described component ratios $X_1$:$Y_1$; $Z_1$ are not made coincident with the initial component ratios X:Y:Z, this condition indicates such a fact that none of the respective refrigerant components R32, R125, and R134*a* have been completely leaked, or all of these refrigerant components R32, R125, and R134*a* have been equally leaked. As a consequence, in this case, the calculation processing unit 10 selects, for example, a refrigerant component having a low boiling point, generally speaking, in which a leakage thereof occurs in the highest degree, and then, issues such an instruction that only a very small amount of this selected refrigerant component is additionally filled.

In this case, the operator fills the refrigerant component R32 by "Xa" (assuming that Xa is 0.1 kg in this case) in accordance with the contents displayed on the display unit 4. In an actual case, certain erroneous amount of the refrigerant component R32 may be produced in the actually-filled refrigerant components by the operator. Assuming now that the refrigerant component R32 of 0.09 kg could be filled, this actual filling amount may be inputted in a next step.

Figure 6:
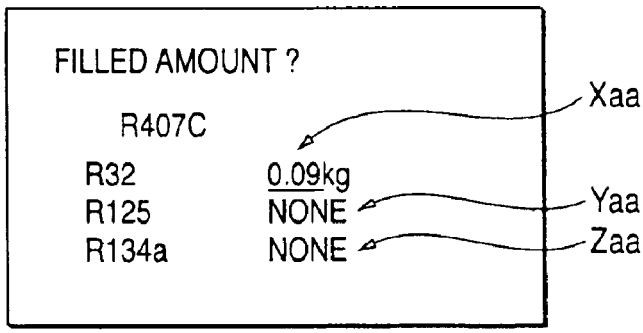
FIG. 6 is a diagram for representing another display example of the display screen made by the refill amount calculating method while the refrigerants are filled.

A step S4 corresponds to a step for inputting an amount of the additionally filled refrigerant component R32. FIG. 6 indicates a display content of the display unit 4 in this step S4. In other words, the operator inputs that the actually filled amount is equal to "Xaa" (assuming that Xaa is 0.09 kg in this case) by employing the cursor keys 5*f* to 5*i*, and the enter key 5*j*.

Figure 7:
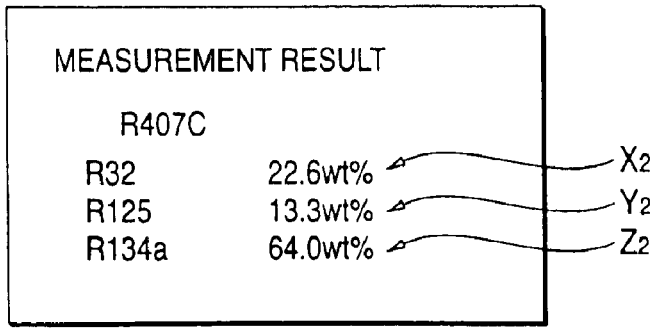
FIG. 7 is a diagram for representing another display example of the display screen made by the refill amount calculating method while the refrigerants are filled.
Figure 8:
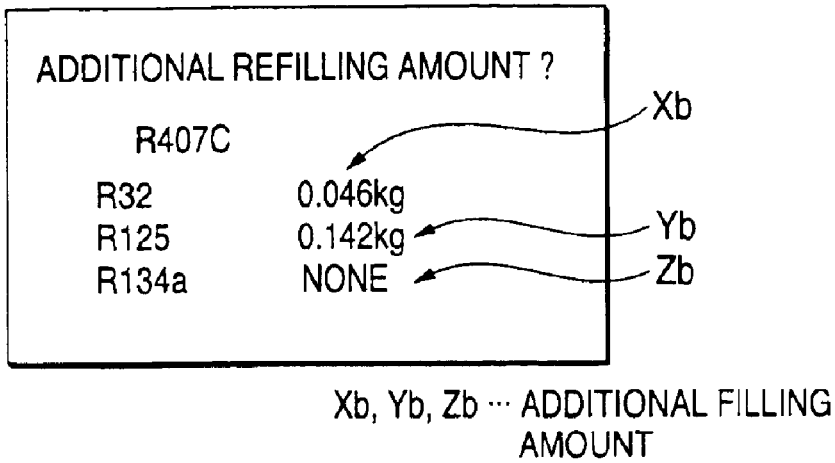
FIG. 8 is a diagram for representing another display example of the display screen made by the refill amount calculating method while the refrigerants are filled.

A step S5 corresponds to a step in which refrigerant component ratios of a mixed refrigerant contained in the refrigerating machine 2 are again measured, and then, measurement results are displayed. FIG. 7 indicates a display content in this step S5. The component ratios of the respective refrigerant components obtained in this case are $X_2$:$Y_2$:$Z_2$.

A step S6 corresponds to a step in which a total amount of refrigerants contained in the refrigerating machine 2 is calculated based upon the component ratios $X_2$:$Y_2$:$Z_2$ under such a condition that the refrigerants have been filled. In other words, as shown in the following formula (2), a total amount "$A_1$" of the refrigerants after the first filling operation has been performed from the change amount of the component ratios may be calculated:

$$A_1=Xaa*(1-X_1)/(X_2-X_1) \quad \text{formula (2)}$$

A step S7 corresponds to such a step in which refilling amounts of the respective refrigerant components R32, R125, and R134*a* are calculated from the total amount $A_1$ of the refrigerants calculated in the above-described step S6, and then, these calculated refilling amounts are displayed. Amounts Xb, Yb, Zb of the respective refrigerant components R32, R125, R134*a* which should be additionally filled may be calculated based upon the below-mentioned formulae (3) to (5), while FIG. 8 indicates such an example that these amounts Xb, Yb, Zb are assumed as 0.046 kg, 0.142 kg, 0 kg. Based upon a display content of FIG. 8, the refilling amounts Xb, Yb, Zb are instructed.

$$Xb=A*X-A_1*X_2 \quad \text{formula (3)}$$

$$Yb=A*Y-A_1*Y_2 \quad \text{formula (4)}$$

$$Zb=A*Z-A_1*Z_2 \quad \text{formula (5)}$$

In this case, the operator fills the respective refrigerant components by the designated amounts in accordance with the contents displayed on the display unit 4. In this example, it is so assumed that the refrigerant component R32 is 0.046 kg and the refrigerant component R125 is 0.142 kg.

Figure 9:
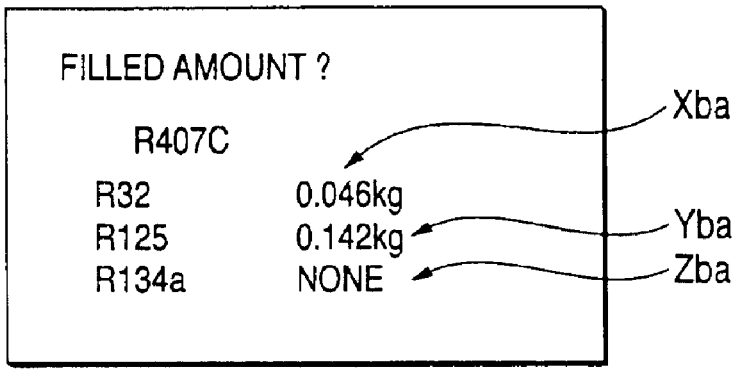
FIG. 9 is a diagram for representing another display example of the display screen made by the refill mount calculating method while the refrigerants are filled.

A step S8 corresponds to such a step for inputting the additionally filled amounts in the actual case. FIG. 9 is a diagram for indicating a display example in this step S8. The operator inputs amounts Xba, Yba, Zba of the respective refrigerant components which are actually and additionally filled by employing the cursor keys 5*f* to 5*i* and the enter key 5*j* on the display screen of FIG. 9. In other words, the operator performs the result input operation.

Figure 10:
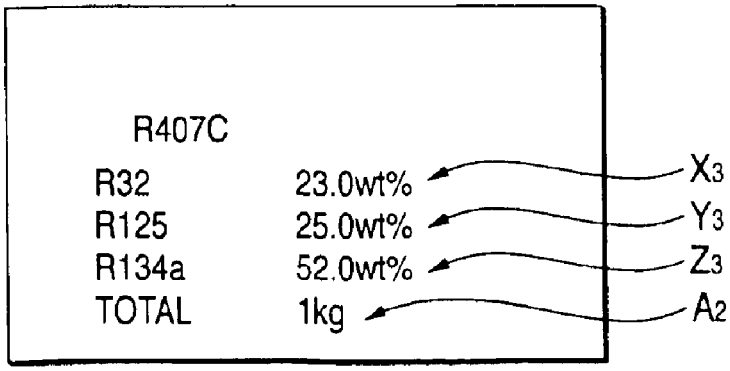
FIG. 10 is a diagram for representing a further display example of the display screen made by the refill amount calculating method while the refrigerants are filled.

A step S9 corresponds to a step in which component ratios of mixed refrigerants contained in the refrigerating machine 2 are again measured, and then, measurement results are displayed. FIG. 10 indicates a display content in this step S9. The component ratios of the respective refrigerant components obtained in this case are $X_3$:$Y_3$:$Z_3$.

A step S10 corresponds to such a step for judging as to whether or not both component ratios of mixed refrigerants and a total amount of the mixed refrigerants after a second refilling operation has been carried out are proper component ratios and a proper total amount. In other words, a total amount "$A_2$" of refrigerants obtained after the second filling operation has been carried out is calculated by employing the filling amounts Xba, Yba, Zba of the respective refrigerant components R32, R125, R134*a*, and also, change amounts of the component ratios $X_2$:$Y_2$:$Z_2$ and $X_3$:$Y_3$:$Z_3$ before/after the refilling operation is carried out. Then, a judgement is made as to whether or not both the component ratios $X_3$:$Y_3$:$Z_3$ and the total amount $A_2$ are located within allowable ranges, as compared with the defined total amount A and the defined component ratios X:Y:Z.

It should be noted that this allowable range may be entered by using the cursor keys 5*f* to 5*i* and the enter key 5*j*, or may be stored in the storage unit 10*m*. Both the allowable range of the component ratios X:Y:Z and the allowable range of the total amount A may be determined in correspondence with the performance of the refrigerating machine 2.

If a judgement is made that the component ratios and the total amount are located outside the allowable ranges in the above-described step S10, the process operation is again returned to the previous step S7 in which additional filling amounts of the respective refrigerant components are instructed, and thus, the refrigerant components can be again refilled.

On the other hand, when it is so judged that the component ratios $X_3$:$Y_3$:$Z_3$ and the total amount $A_2$ are located within the allowable range in the step S10, the filling operation may be accomplished.

Since the refrigerant refill amount calculating apparatus 1 of the present invention is employed, the operator can calculate the proper filling amounts for the short refrigerant components which have been reduced due to leakages thereof without performing the cumbersome calculations, and can adjust the component ratios in an easy manner.

Also, even if the operator does not extract all amounts of the fluorocarbon from the refrigerating machine 2, since the operator can adjust the total amount of fluorocarbon in such a manner that this total amount becomes the amount defined by the refrigerating machine 2, not only the disposal cost of the waste fluorocarbon which has been required in the prior art can be eliminated, but also the amount of the refrigerant component to be filled can be reduced. In other words, not only the filling works of the refrigerants can be carried out in the simple and quick manner, but also the consumption of the fluorocarbon can be reduced as large as possible, which may contribute the preservation of the earth environment.

Furthermore, in the refrigerant refill amount calculating apparatus 1 of the present invention, the non-dispersion type infrared gas analyzing meter is employed as the construction of the concentration measuring unit so as to acquire the component ratios of the respective refrigerant components, so that the quantitative measurement can be carried out in higher precision, and also, the calculating apparatus 1 can be made compact, and further, the operator can readily calculate the additional filling amount.

However, the present invention is not limited only to such an refrigerant refill amount calculating apparatus that a non-dispersion type infrared gas analyzing meter is employed as a concentration measuring unit, but may be applied to another refrigerant refill amount calculating apparatus that a concentration measuring apparatus is constituted by employing another optical method such as a FTIR. Furthermore, in the case that a mass spectrometry is employed as a concentration measuring unit, component ratios may be more correctly calculated by merely acquiring a very small amount of fluorocarbon S.

Also, in the above-described embodiment mode, the refrigerant refill amount calculating apparatus 1 outputs the amounts of the respective refrigerant components to be filled on the display unit 4 with respect to the operator, and the operator fills the respective refrigerant components, and thereafter, the operator enters the actually filled amounts to the refrigerant refill amount calculating apparatus 1 by manipulating the input unit such as the keyboard 5. As a result, the refrigerant refill amount calculating apparatus 1 can be made similar and compact as being permitted as possible.

However, the above-described refrigerant refill amount calculating apparatus 1 may contain a flow rate meter for measuring flow rates of refrigerant components to be filled, and measures amounts of refrigerant components which could be actually filled, so that filling amounts of these refrigerant components may be entered. In this alternative case, while the input unit is the flow rate meter, this flow rate meter measures the amounts of the refrigerant components which could be actually filled by integrating the flow rates, so that the filling amounts of these actually filled refrigerant components may be more correctly entered, and thus, the operation efficiency may be improved.

Furthermore, in such a case that the above-described refrigerant refill amount calculating apparatus 1 owns such a control valve capable of controlling filling operations of refrigerant components to be filled, the refrigerant components may be automatically filled in a proper manner.

As previously explained, in accordance with the refrigerant refill amount calculating apparatus and the refrigerant refill amount calculating method of the present invention, only the amounts of the short refrigerant components can be very easily calculated, and this calculated short amount can be instructed with respect to the refrigerating machine using the mixed refrigerant, so that the total amount of such fluorocarbon which is used to fill the refrigerants can be simply reduced.

What is claimed is:

1. A refrigerant refill amount calculating apparatus comprising:

a concentration measuring unit which measures component ratios of a mixed refrigerant contained in a refrigerating machine; and a calculation processing unit which calculates refill amounts of respective refrigerant components which are required to fill a mixed refrigerant having a defined amount in defined component ratios into the refrigerating machine based upon an amount of a refrigerant component which has been additionally filled into the refrigerating machine, and also, a change amount of component ratios which have been measured before and after the refrigerant component was filled.

2. A refrigerant refill amount calculating apparatus as claimed in claim 1, further comprising:

an output unit for instructing the refill amounts of the refrigerant components calculated in said calculation processing unit.

3. A refrigerant refill amount calculating apparatus as claimed in claim 1, wherein said concentration measuring unit includes:

a measuring cell into which the mixed refrigerant is conducted;

an infrared light source irradiating infrared rays to said measuring cell; and a detecting unit detecting infrared rays which has passed through said measuring cell.

4. A refrigerant refill amount calculating method comprising the steps of:

measuring refrigerant component ratios of a mixed refrigerant, having a plurality of refrigerant components, filled into a refrigerating machine, wherein said measurement is based upon an amount of at least one of said refrigerant components which has been filled into the refrigerating machine and a change amount of said component ratios, wherein said change amount of said component ratios is calculated based on a measurement of said component ratios prior to and after said at least one refrigerant component has been filled;

refilling an amount of said refrigerant components;

measuring again the refrigerant component ratios of said mixed refrigerant; and calculating refill amounts of said refrigerant components which is required to fill said refrigerating machine so that said mixed refrigerant has defined refrigerant component ratios.

5. A refrigerant refill amount calculating method as claimed in claim 4 wherein infrared rays are caused to pass through said mixed refrigerant, and then, penetrated infrared rays are detected so as to obtain the refrigerant component ratios of said mixed refrigerant.

* * * * *